US005267795A

United States Patent [19]

Bernstein et al.

[11] Patent Number: 5,267,795

[45] Date of Patent: Dec. 7, 1993

[54] CARRYOUT FOOD BAG WITH CLOSURE AND MEANS OF ORDER VERIFICATION

[75] Inventors: Linda A. Bernstein, Campbell Hall; Robert L. Gordon, Monroe, both of N.Y.

[73] Assignee: International Paper Company, Purchase, N.Y.

[21] Appl. No.: 941,283

[22] Filed: Sep. 4, 1992

[51] Int. Cl.[5] ..... B65D 33/24

[52] U.S. Cl. ..... 383/88; 383/85; 383/209

[58] Field of Search ..... 383/28, 35, 209, 83, 383/85, 86, 86.1, 86.2; 229/313, 314, 316, 87.03

[56] References Cited

U.S. PATENT DOCUMENTS

| | | | |
|---|---|---|---|
| 304,662 | 9/1884 | Pedrick | 383/206 X |
| 1,310,288 | 7/1919 | Nico . | |
| 1,619,177 | 3/1927 | Avery . | |
| 2,099,425 | 11/1937 | Goodman . | |
| 2,215,989 | 9/1940 | Wolf | 383/35 X |
| 2,226,943 | 12/1940 | Poppe . | |
| 2,274,934 | 3/1942 | Piazze . | |
| 2,463,302 | 3/1949 | Orchard | 383/88 X |
| 2,686,004 | 8/1954 | Reiss | 383/88 X |
| 2,735,215 | 2/1956 | Rutledge . | |
| 2,756,923 | 7/1956 | Poppe | 383/86 X |
| 2,837,267 | 6/1958 | Potdevin . | |
| 3,690,542 | 9/1972 | Jernstrom . | |
| 4,059,222 | 11/1977 | Gamble | 383/86 X |
| 4,444,354 | 4/1984 | Staelgraeve . | |
| 4,461,031 | 7/1984 | Blamer | 383/123 |
| 4,557,385 | 12/1985 | Robinson . | |
| 4,618,992 | 10/1986 | La Grotteria . | |
| 4,750,663 | 6/1988 | Behne . | |
| 4,865,549 | 9/1989 | Sonsteby . | |
| 4,898,477 | 2/1990 | Cox et al. | 383/209 X |
| 5,114,243 | 5/1992 | Thier | 383/85 |

FOREIGN PATENT DOCUMENTS

| | | | |
|---|---|---|---|
| 834640 | 3/1952 | Fed. Rep. of Germany | 383/88 |

*Primary Examiner*—Allan N. Shoap
*Assistant Examiner*—Christopher McDonald
*Attorney, Agent, or Firm*—Michael J. Doyle

[57] ABSTRACT

A paper bag particularly adapted for the packaging of carryout food items such as hamburgers and chicken. The bag is of a unitary construction and includes two inwardly folded bellows panels on its sides, each bellows joining respective sides of the bag. A fold line is positioned below the top, free edges of the side walls. A pair of spaced cuts is located substantially midway of respective fold lines, each cut of each pair extending from above to below its respective fold line, the individual cuts being spaced from each other along the fold line. Respective areas of the front and rear bag walls above the fold line carry indicia, such as printed indicia, to indicate the bag contents. After folding the top of the bag about the fold lines and against either side walls, one or the other indicia is visible to indicate the bag contents. The bag top is inhibited from opening after such folding by distorting the paper between the cuts to effect a latching action.

7 Claims, 2 Drawing Sheets

FIG. 3
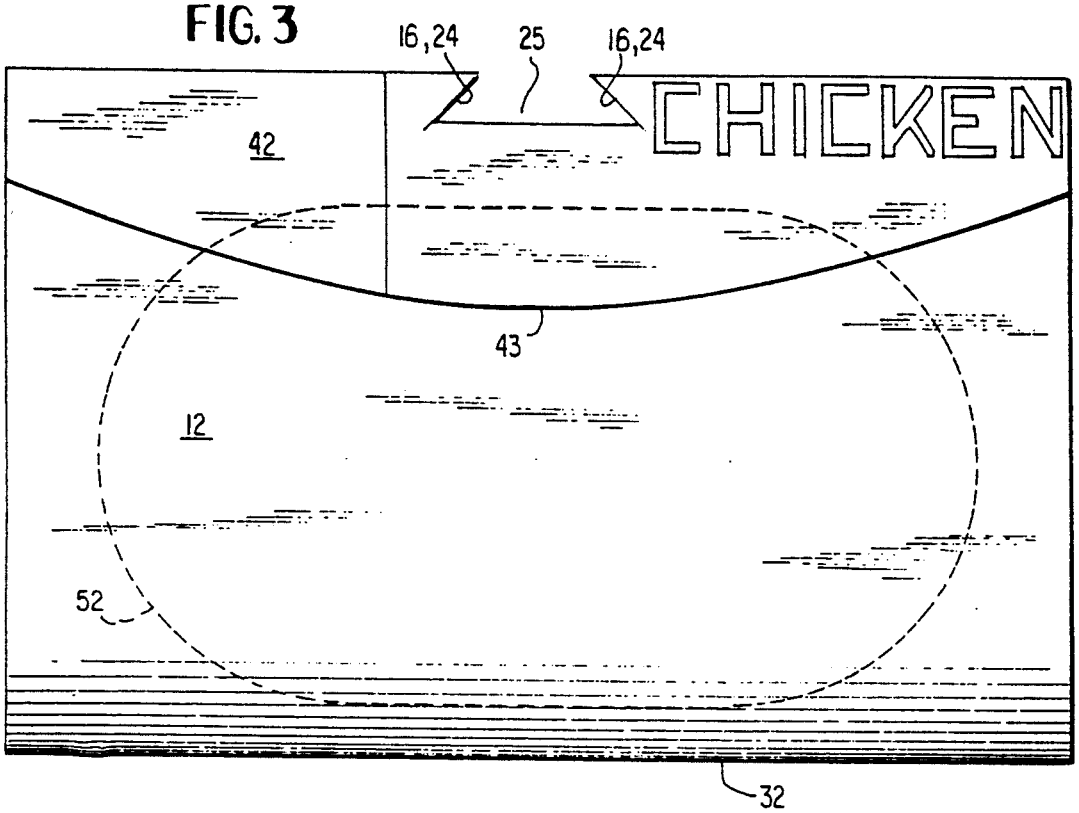
FIG. 4
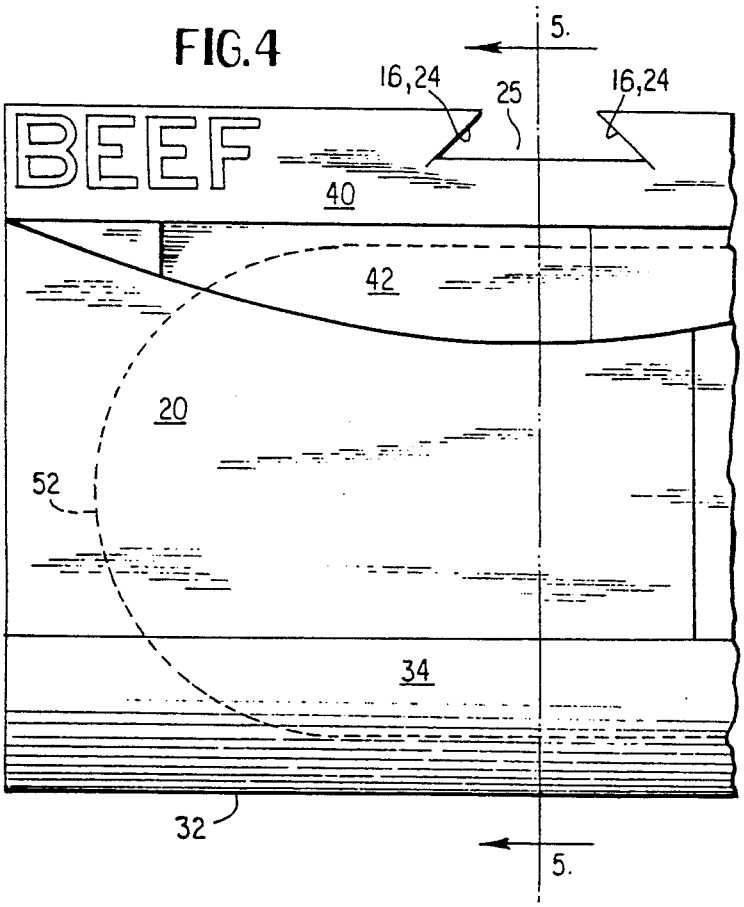
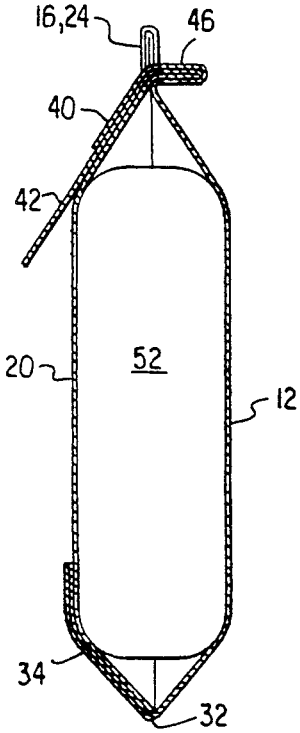
FIG. 5

CARRYOUT FOOD BAG WITH CLOSURE AND MEANS OF ORDER VERIFICATION

BACKGROUND OF THE INVENTION

This invention relates to packaging and more particularly to a paper bag construction for packaging so called fast foods.

It is common in the fast food industry to employ packaging that will not only contain and protect a food item, but also identify it. A fast food outlet may offer several food items in similar packages and it is desirable to differentiate them for the purpose of order verification by some packaging feature, i.e., printing, packaging shape, etc. Because there is generally limited space to maintain an inventory of packaging supplies, any means of reducing the amount of packaging containers is clearly desirable. One example of a food container having variable indicia to designate different food products therein is shown in U.S. Pat. No. 4,472,896 issued to Brauner et al.

SUMMARY OF THE INVENTION

According to the practice of this invention, a paper bag is so configured and marked, as by printing, as to visually denote either of two fast food types. The bag is folded over at its top, and latched in a folded over configuration by bending a portion of the top fold. In one folded over configuration, one marking is displayed while the other is hidden from view, and vice versa for the other folded over configuration.

One feature of the invention is a perforation of the bag at each side thereof and located at an appropriate distance from the bag top to permit fold-over for heat retention and product containment. The perforations also allow for a quick visual identification of the correct fold axis or line. In addition, the perforations create a better dead fold (stays folded) in paper, making it easier to keep the bag closed. If dead fold of the paper is not critical, then a simple crease or score line will suffice.

Another characteristic is a respective name or description of the product, printed upside down, above each of the perforation. A food name is printed on one side and another food name on the other side. The top of the bag can be folded down one way or the other, depending on which food item is placed in the bag, so that the correct food name is displayed right side up at the bag top. More than one perforation or fold can be used to achieve the same result. Graphics can be used to enhance easy visual location of the perforated or score lines for quick closure of the package by food outlet employees.

Yet another feature of the invention relates to a set of die-cuts or butterfly cuts located on the perforation lines such that a die-cut tab is created when the bag top is folded closed. This tab can be bent or folded over in the opposite direction from the bag top fold, making a positive closure on the bag for better heat retention and product containment.

If more than one perforated fold-over line is used to make double or triple top folds, the bag tube when opened starts to become too deep. To facilitate access to the food, the top of the bag can be torn away by the consumer at one of the perforated lines. If enough of the top of the bag is torn away, a little hand held pocket is created from which the food can be eaten.

Using one bag to package two or more food products is an advantage in inventory control since only one supply need be maintained in one place in a food outlet. There will be no chance to run out of one type as opposed to the other and it will not be necessary to order differing amounts of one type.

Less material and a different material can be used by the customer. For example, a foil material with good dead fold properties is not required due to the perforations and butterfly cuts. Also, it is not necessary to package the product in a bulkier folding carton or foam container when a stiff paper will provide protection, containment, and heat retention. Less secondary packaging (corrugated or other shipping material) is used to deliver the bag packaging.

BRIEF DESCRIPTION OF THE DRAWINGS

FIG. 3 is an elevational view taken from one side of the bag and illustrating the bag in its closed and latched configuration, with the outline of a food product such as a sandwich therein being indicated by dashed lines.

FIG. 4 is a view similar to FIG. 3, also showing the bag closed and containing a sandwich, and viewed from the opposite side with respect to FIG. 3.

FIG. 5 is a view taken along section 5—5 of FIG. 4.

DETAILED DESCRIPTION OF THE INVENTION

Figure 1:
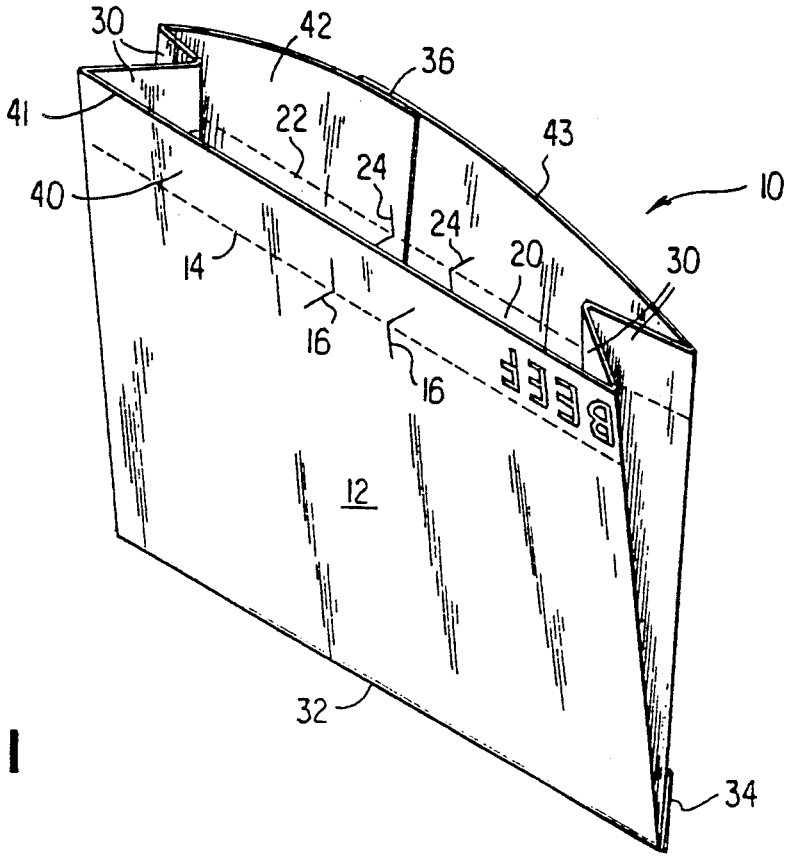
FIG. 1 is a perspective view looking at the bag of this invention from one side; the bag shown in its open, empty form.

Referring now to FIG. 1 of the drawings, the numeral 10 denotes generally the paper bag of this invention, the bag being shown in its open, food product accepting configuration. The bag includes a first side 12 whose upper portion includes a perforated tear and fold line 14, the tear line being interrupted substantially midway thereof by a pair of latching or butterfly cuts 16, each at an angle to the tear line, which extend completely through the paper sheet material which forms the bag. The other side of the bag is indicated by 20, this side also having a perforated tear and fold line at its upper portion, the latter denoted as 22 and interrupted substantially midway thereof by a pair of latching or butterfly cut lines 24, again spaced apart from each other as butterfly cut lines 16 of side 12. The two sides 12 and 20 are joined by gussets 30 which include continuations of the perforated lines. The lower portion of the bag includes an edge 32 formed by folding over a generally rectangular section 34, of double thickness, and gluing it against side 20.

While the manner of formation of the bag forms no part of this invention, one method is to cut predetermined lengths along a longitudinal paper web of indefinite length, and then form for each length, a tube-like structure having a overlapped or seam 36, and then form the bottom of the bag by collapsing the tube at the bottom thereof and folding portion 34 about a fold line which forms bottom edge 32.

That portion of bag side 12 above perforated line 14 is designated as 40 and is seen to be generally rectangular. The indicated graphics BEEF are printed or otherwise affixed upside down, to one end of section 40. Similarly, that portion of side 20 of the bag above perforated line 22 is designated as 42. It is seen that the free, upper edge 43 of section 42 extends above the free upper edge 41 of section 40, with the former also being convexly curved upwardly.

Figure 2:
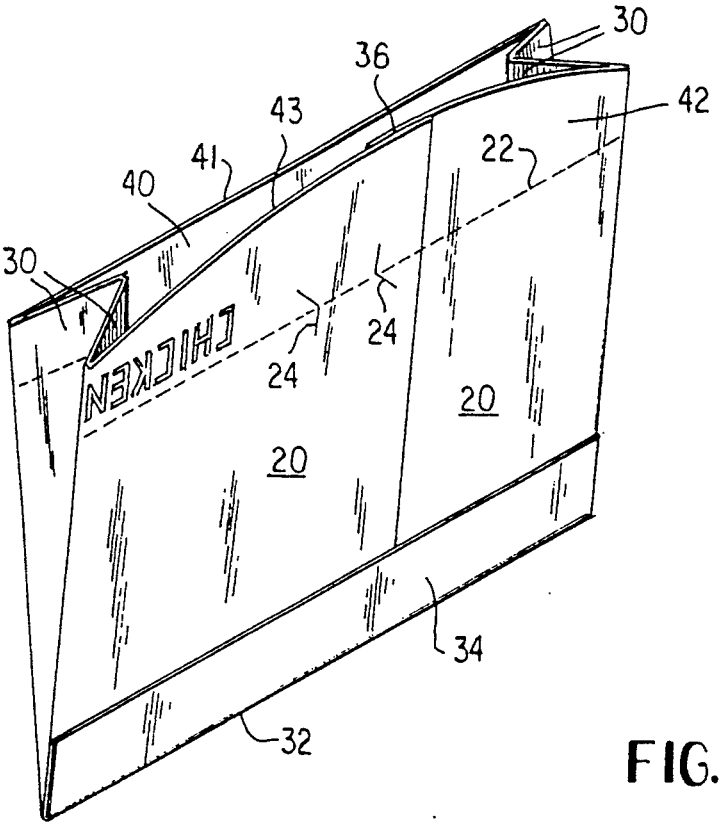
FIG. 2 is a view similar to FIG. 1, but viewing the bag from the opposite or other side.

Referring now to FIG. 2 of the drawings, the other bag side 20 is shown, and the reader will observe that a different indicia such as CHICKEN is printed upside down and above perforated line 22 on section 42.

In operation, a food product, such as either a beef sandwich or a chicken sandwich, is placed in the bag. Assuming that a chicken sandwich has been placed in the bag, the top of the bag is folded to the left as viewed in FIG. 2, with the double thickness defined by sections 40 and 42 being folded about now touching fold lines 14 and 22, so as to assume the configuration shown at FIG. 3. It will observed, from a consideration of FIG. 2, that bending sections 40 and 42 about their respective perforated lines will result in the legend CHICKEN being seen in its proper orientation. By folding the paper material between the butterfly cuts 16, 16 and 24, 24, a void 25 at the upper bag portion is defined. The outline of a chicken sandwich is indicated by the dashed lines at FIG. 3. A tab 46 is defined by displacing the paper material between the butterfly cuts 16, 16 and 24, 24 so as to produce the void 25 substantially midway of the top of the now closed paper bag. The bending and formation of tab 46 latches the top edges of the bag together.

Referring now to FIG. 4, a beef sandwich has been placed in the bag, and the top sections 40, 42 of FIG. 1 have been bent towards the right, to thus display, properly, the legend BEEF. Again, the material between the butterfly cuts 16, 16 and 24, 24 is bent to define a tab 46. FIG. 5 also shows in cross section, somewhat schematically, a sandwich 52 as well as the tab 46. Thus either one of the two indicia BEEF or CHICKEN is displayed while the other legend is hidden from view. FIG. 5 also shows the difference in height of free edges 41 and 43 of respective sections 40 and 42. If a section of FIG. 3 had been taken, similar to section 5—5 of FIG. 4, tab 46 would extend to the left, and section 42 would overlie section 40.

In use, the consumer may reverse the fold over sealing and latching steps, or alternatively, gain access to the food product by ripping the top of the bag off by tearing the perforated lines in the sides and in the two bellows.

Geometrical terms of orientation are employed to facilitate the description of the invention, and are not intended as terms of limitations.

We claim:

1. A gusseted paper bag having first and second side walls, each of said walls having side edges and an uppermost free edge, respective said side edges of said side walls joined by a respective inwardly folded gusset panel to thereby form sides of the bag, bottom edges of said side walls joined together to form a bottom for the bag, a perforated fold line extending across the uppermost portion of each of said side walls, said fold line located beneath said respective uppermost free edges of said side walls, said fold lines also extending across said respective gusset panels, a pair of latching cuts extending through each of said side wall and perforated lines, said latching cuts being spaced from each other, each one of said pair of latching cuts extending from above a respective said fold line to below a respective said fold line, said cuts each located substantially midway of said fold lines, whereby those portions of said side walls and said gusset panels above said fold lines can be folded down so as to lie on a respective one of said side walls, and whereby the folded down portion can be latched to its folded down position to prevent the bag from opening by distorting the paper which lies between said pairs of latching cuts.

2. The bag of claim 1 wherein the bag is formed of a one piece construction.

3. The bag of claim 1 wherein the uppermost free edge of one of said side walls is straight.

4. The bag of claim 3 wherein the uppermost free edge of the other of said side walls is convexly curved upwardly and is above said uppermost free edge of the first recited side wall.

5. The bag of claim 1 wherein said bottom of said bag is formed to an edge by a bottom fold.

6. The bag of claim 1 wherein said fold lines are each defined by a series of perforations to thereby permit those portions of the bag above said fold lines to be torn off.

7. The bag of claim 1 including different indicia above said respective fold lines on respective portions of said side walls, said indicia being on respective outer portions of said side walls, whereby when folded, the folded down bag portion obscures one of said different indicia while leaving the other indicia viewable.

* * * * *